US006551961B1

(12) United States Patent
Midorikawa et al.

(10) Patent No.: US 6,551,961 B1
(45) Date of Patent: Apr. 22, 2003

(54) THERMAL RECORDING MATERIAL

(75) Inventors: Yoshimi Midorikawa, Tokyo (JP); Naomi Sumikawa, Tokyo (JP); Kaoru Hamada, Tokyo (JP); Yoshihide Kimura, Tokyo (JP)

(73) Assignee: Nippon Paper Industries Co Ltd, Tokyo (JP)

( * ) Notice: Subject to any disclaimer, the term of this patent is extended or adjusted under 35 U.S.C. 154(b) by 0 days.

(21) Appl. No.: 09/674,309

(22) PCT Filed: Mar. 3, 2000

(86) PCT No.: PCT/JP00/01301

§ 371 (c)(1),
(2), (4) Date: Oct. 31, 2000

(87) PCT Pub. No.: WO00/53427

PCT Pub. Date: Sep. 14, 2000

(30) Foreign Application Priority Data

Mar. 5, 1999 (JP) ..... 11-058113
Jun. 16, 1999 (JP) ..... 11-169166

(51) Int. Cl.[7] ..... B41M 5/30
(52) U.S. Cl. ..... 503/217; 503/221
(58) Field of Search ..... 503/216, 217, 503/221

(56) References Cited

U.S. PATENT DOCUMENTS

| | | | | |
|---|---|---|---|---|
| 4,459,336 A | | 7/1984 | Miyakawa | 503/208 |
| 4,500,354 A | | 2/1985 | Katsen et al. | 106/21 |
| 5,378,674 A | | 1/1995 | Kobayashi et al. | 503/208 |
| 5,401,699 A | * | 3/1995 | Ohashi et al. | 503/217 |
| 5,876,898 A | * | 3/1999 | Ikeda et al. | 430/203 |

FOREIGN PATENT DOCUMENTS

JP 08216528 8/1996

OTHER PUBLICATIONS

Patent Abstract of Japan, Japanese Patent Office, Publ. No. 04110191, date of publication of application Apr. 10, 1992.
Patent Abstract of Japan, Japanese Patent Office, Publ. No. 04103386, date of publication of application, Apr. 6, 1992.
Patent Abstract of Japan, Japanese Patent Office. Publ. No. 10278433, date of publication of application, Oct. 20, 1998.
Patent Abstract of Japan, Japanese Patent Office, Publ. No. 05221141, date of publication of application, Aug. 31, 1993.
Patent Abstract of Japan, Japanese Patent Office, Publ. No. 06312580, date of publication of application, Nov. 8, 1994.
Patent Abstract of Japan, Japanese Patent Office, Publ. No. 06255264, date of publication of application, Sep. 13, 1994.
Patent Abstract of Japan, Japanese Patent Office, Publ. No. 05050766, date of publication of application, Mar. 2, 1993.
Patent Abstract of Japan, Japanese Patent Office, Publ. No. 57178793, date of publication of application, Nov. 4, 1982.
Patent Abstract of Japan, Japanese Patent Office, Publ. No. 11157220, date of publication of application Jun. 15, 1999.
Patent Abstract of Japan, Japanese Patent Office, Publ. No. 11208122, date of publication of application Aug. 3, 1999.
Patent Abstract of Japan, Japanese Patent Office, Publ. No. 07156558, date of publication of application Jun. 20, 1995.
Patent Abstract of Japan, Japanese Patent Office, Publ. No. 02249690, date of publication of application Oct. 5, 1990.
Patent Abstract of Japan, Japanese Patent Office, Publ. No. 06255258, date of publication of application Sep. 13, 1994.

* cited by examiner

*Primary Examiner*—Bruce H. Hess
(74) *Attorney, Agent, or Firm*—Sherman & Shalloway

(57) ABSTRACT

A thermal recording material which has high sensitivity in color development and a high whiteness of the background and is excellent in image retention and heat resistance. The thermal recording material contains a dihydroxydiphenylsulfon compound represented by general formula (1) as an organic color developer and 3-di-n-pentylamino-6-methyl-7-anilinofluoran as a colorless basic dye.

(1)

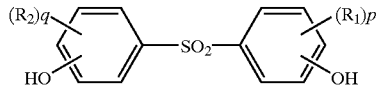

(In the formula, $R_1$ and $R_2$ each represents $C_{1-8}$ alkyl, alkenyl, or halogeno; and p and q each is an integer of 0 to 3.)

5 Claims, No Drawings

THERMAL RECORDING MATERIAL

FIELD OF THE INVENTION

The present invention relates to a thermal recording material, which has good color developing sensitivity, excellent degree of whiteness of ground color, good image retention and strong resistance to heat.

DESCRIPTION OF THE PRIOR ART

In general, a thermal recording material having a thermally sensitive color developing layer mainly composed of colorless or pale colored basic colorless dye and color developing agent that develops color by reacting with said basic colorless dye when heated is disclosed in Japanese patent publication 45-14039 and widely used in commercial scale. A thermal printer in which a thermal head is installed is used for the recording method of said thermal recording material. Since this kind of thermal recording method superiors to the conventional recording method from the view point of noiseless at recording process, does not need developing and fixing processes, maintenance free, equipment is relatively cheap and compact and the obtained image is very clear, therefore, this method is widely applied in the field of facsimile or computer, various kinds of measuring instrument and for a labeling machine along with the growth of an information industry. The recording devices attached to these instruments are becoming more diversified and more high-performance, and the required quality to the thermal recording material is becoming more severe. Along with the miniaturization of an instrument and requirement for higher recording speed, it becomes necessary to obtain deep and clear color developing image. Further, more close qualities to ordinary paper are required to the thermally sensitive recording paper. Namely, for instance, to have an excellent whiteness, the coloring of ground color is very small at high temperature and high humidity condition and the fading of color developed part is very small.

For the purpose to meet said requirement, for example, in the Japanese Patent Laid open Publication 56-169087, a method to improve the color developing sensitivity by adding a thermo fusional substance to a thermally sensitive layer is disclosed, and in the Japanese Patent Laid Open Publication 56-144193, a method to improve the color developing sensitivity by using new color developing agent which has high color developing ability is disclosed. However, these methods can not be said to have a sufficient quality, because these methods have defects such as deterioration of ground color by heat, powder generation by aging and dropping of color density after preserved for long time (reprinting ability).

As the compound that is usually used as the color developing agent, sulfone type compound or salitylic acid type compound can be mentioned besides the phenol type compound. However, not only the resistance to heat or to humidity of these compounds of themselves is not sufficient, but also when used together with a sensitizer, the resistance to heat or to humidity is further deteriorated. Dihydroxydiphenylsulfone compound which is used as an organic color developing agent in this invention is a well-known compound, however, the color developing ability of it is low and it is difficult to meet the current requirement for high sensitivity. Further, when a coating for the thermally sensitive recording layer is prepared, the coloring problem of coating itself occurs, therefore, it is difficult to obtain the thermal recording material that is excel in degree of whiteness of the ground color.

DISCLOSURE OF THE INVENTION

The object of this invention is to provide a thermal recording material which has high color developing ability and excellent degree of whiteness of the ground color, further, excellent image retention and strong resistance to heat.

The inventors of this invention have conduced an intensive study and have found that in a thermal recording material that possesses a thermally sensitive recording layer containing colorless or pale colored basic colorless dye and organic color developing agent as a main component, when said thermally sensitive recording layer contains at least one kind of dihydroxydiphenylsulfone type compound represented by following general formula (1) and contains 3-di-n-pentylamino-6-methyl-7-anilinofluoran as a basic colorless dye, the above mentioned object can be achieved, and accomplished the present invention.

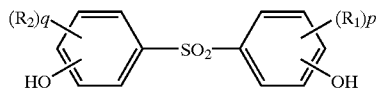

(1)

In the formula, $R_1$ and $R_2$ indicate alkyl group or alkenyl group of carbon number 1 to 8, or halogen atom and p and q indicate an integer number of 0 to 3.

In general, it is concerned that the coloring of coating is caused by partially dissolving of the material contained in the coating in water and the dissolved material reacts with dye and cause the coloring. For example, the degree of whiteness of thermal recording material that contains 4,4'-dihydroxydiphenylsulfone is remarkably deteriorated. The reason why is concerned that because 4,4'-dihydroxydiphenylsulfone contains two —OH groups, which make the basic colorless dye develop color and is easily soluble in water and the polarity of the molecular is comparatively high. Further, when basic colorless dye is more finely ground, the deterioration of degree of whiteness becomes more remarkable. By the intensive study of the inventors, it is found that the combination use of 3-di-n-pentylamino-6-methyl-7-anilinofluoran as the basic colorless dye can specifically prevent the coloring of the coating and prevent the deterioration of whiteness of thermal recording material even if the basic colorless dye is finely ground. The reason why is not made clear, however, it is guessed that because the solubility of 3-di-n-pentylamino-6-methyl-7-anilinofluoran is smaller than $1.349\times10^{-6}$ g/l, which is concerned very low solubility.

THE BEST EMBODIMENT TO CARRY OUT THE INVENTION

The thermal sensitive recording medium of this invention, for example, can be produced by following method. That is, prepare the dispersion in which basic colorless dye, color developing agent are dispersed with a binder, then a filler and other necessary additives are added and mixed. Thus the coating for a thermal sensitive color developing layer is prepared. The prepared coating is coated on a substrate and dried up so as to form a thermal sensitive color developing layer. The desirable mixing ratio of basic colorless dye and color developing agent is 1–6 parts of color developing agent to 1 part of dye, and the mixing ratio is in said range, the color developing sensitivity and the ground color resistance to heat are well balanced.

In this invention, dihydroxydiphenylsulfone compound represented by general formula (1) is contained as an organic color developing agent. The concrete example of general formula (1) can be mentioned below. However, not intend to be limited to these compounds. And these compounds can be used alone or together with.

4,4'-dihydroxydiphenylsulfone, 2,4'-dihydroxydiphenylsulfone, bis-(3-allyl-4-hydroxyphenyl)sulfone, 3,3'-dimethyl-4,4'-dihydroxydiphenylsulfone, 3,3',5,5'-tetramethyl-4,4'-dihydroxydiphenylsulfone, 2,2'-bis(4-chlorophenol)sulfone, 4-hydroxyphenyl-3'-isopropyl-4'-hydroxyphenylsulfone, bis-(3-ethyl-4-hydroxyphenyl)sulfone, 2,2'-bis(p-t-butylphenol)sulfone, 2,2'-bis(p-t-pentylphenol)sulfone and 2,2'-bis(p-t-octylphenol)sulfone Among these compounds, 4,4'-dihydroxydiphenylsulfone is preferably used, because of the qualities of obtained thermal recording material are well balanced, and especially the image retention in high temperature and in high humid condition are excellent.

In this invention, the average particle size of basic colorless dye and color developing agent are not restricted, however, when the average particle size of 3-di-n-pentylamino-6-methyl-7-anilinofluoran, which is basic colorless dye is smaller than 0.5 $\mu$m, the color developing sensitivity and the resistance to heat is improved. More desirable average particle size is smaller than 0.4 $\mu$m. In general, when the particle size of dye becomes smaller, it becomes more easily soluble in water and the reactivity between dye and color developing agent is improved because these compounds exist in molecular condition, the problem of ground color coloring is caused. However, in a case of 3-di-n-pentylamino-6-methyl-7-anilinofluoran, such kind of problem does not cause, and the thermal recording material of high quality can be obtained. The reason why is not made clear, however, it is concerned because the solubility to water is very poor.

In this invention, conventional well known sensitizer can be used in the limitation not to prevent the desired effect. As the concrete examples of the sensitizer, compounds mentioned below can be used, however, not intend to be limited to these compounds. And these compounds can be used alone or together with, fatty acid amide, ethylene bis amide, montanic acid wax, polyethylene wax, 1,2-di-(3-methylphenoxy)ethane, diphenylsulfone, p-benzylbiphenyl, β-benzyloxynaphthalene, 4-biphenyl-p-tolylether, m-tarphenyl, 1,2-diphenoxyethane, dibenzyl 4,4'-ethylenedioxy-bis-benzoate, dibenzoyloxymethane, 1,2-di-(3-methylphenoxy)ethylene, 1,2-diphenoxyethylene, bis[2-(4-methoxy-phenoxy)ethyl]ether, p-nitromethylbenzoate, dibenzyloxalate, di(p-chlorobenzyl)oxalate, benzyl p-benzyloxy benzoate, di-p-tolylcarbonate, phenyl-α-naphthylcarbonate, 1,4-diethoxynaphthalene, phenyl 1-hydroxy-2-naphthoate, o-xylene-bis-(phenylether)

4-(m-methylphenoxymethyl)biphenyl o-toluensulfoneamid and p-toluensulfoneamid can be mentioned, however, not intends to be limited to them. These sensitizer can be used alone or can be used together with.

By the use of a sensitizer, sometimes the resistance to heat or humidity is remarkably deteriorated. Therefore, basically the use of sensitizer is not desirable, and if it is necessary to be used, the kind of sensitizer must be carefully selected.

As the binder to be used in this invention, full saponificated polyvinyl alcohol whose degree of polymerization is 200–1900, partially saponificated polyvinyl alcohol, carboxyl denatured polyvinyl alcohol, amide denatured polyvinyl alcohol, sulfonic acid denatured polyvinyl alcohol, butyral denatured polyvinyl alcohol, other denatured polyvinyl alcohol, hydroxyethyl cellulose, methyl cellulose, carboxymethyl cellulose, ethyl cellulose, cellulose derivative such as acetyl cellulose, polyvinyl chloride, polyvinyl acetate, polyacrylamide, polyacrylamideester, polyvinyl butyral, polystyrol and these copolymer, styrene-maleic acid unhydride copolyme,r styrene-buthadiene copolymer, silicone resin, petroleum resin, terpene resin, ketone resin and coumarone resin can be mentioned. These high polymer substances can be used by dissolving in solvents such as water, alcohol, ketones, esters and hydrocarbons, or, can be used in a state of aqueous emulsion or paste condition at need.

Further, in this invention, as the image stabilizer showing oil resistance effect of recorded image, 4,4'-buthylidene(6-t-buthyl-3-methylphenol), 2,2'-di-t-buthyl-5,5'-dimethyl-4,4'-sulphonyidiphenol, 1,1,3-tris(2-methyl-4-hydroxy-5-cyclohexylphenyl) buthane, 1,1,3-tris(2-methyl-4-hydroxy-5-t-buthylphenyl)buthane, 4-benzyloxy-4'-(2,3-epoxy-2-methylpropoxy) diphenylsulfone and epoxy resin can be added in the limit not to prevent above mentioned desired effect.

As a filler which can be used in this invention, an inorganic or an organic filler such as silica, calcium carbonate, kaoline, calcined kaoline, diatomaceous earth, talc, titanium oxide or aluminum hydroxide can be mentioned. Further, a slipping agent such as waxes, an ultra violet ray absorbing agent such as benzophenone type or triasol type compound, a water proof agent such as glioxasal, a dispersing agent, a defoamer, an anti oxidation agent and fluoresene dye can be used.

Referring to the amount of color developing agent and basic colorless dye to be used to the thermal recording material of this invention, the kind and amount of them and other additives are decided according to the required quality and recording feature, and not restricted. However, in general, it is preferable to use 0.5–4 parts of filler to 1 part of color developing agent of this invention. And the desirable amount of binder is 5–25% to the total amount of solid.

The coating composed of above mentioned component is coated over the surface of substrate such as paper, recycled paper, synthetic paper, film, plastic film, plastic foam film or non-woven cloth, and the desired thermal recording material can be obtained. The complex sheet composed of above mentioned materials can also be used.

And, for the purpose to improve the preservative property, an overcoat layer composed of high polymer compound can be prepared on the thermally sensitive color developing layer. Further, for the purpose to improve the color developing sensitivity, an undercoat layer composed of high polymer substance containing a filler can be prepared under the thermally sensitive layer. The aforementioned organic color developing agent, basic colorless dye and other additives, which are added at need, are ground to the fine particles smaller than several microns diameter by means of a grinder or an adequate emulsifying apparatus, then substantially used. The method for pulverizing is not restricted, however, usually, materials such as basic colorless dye and color developing agent are dispersed with water and a binder to an uniform suspension, then ground using a ball mill, an attriter, a vertical sand grinder or a horizontal sand grinder.

Further, a binder and other additives are added at need and the coating is prepared. The method to coat is not restricted, however, can be coated by conventional well known methods, for example, an off machine coating machine with various coater such as air knife coater, rod blade coater, bill blade coater or roll coater, or an on machine coating machine can preferably be used.

EXAMPLE

The thermal recording material of this invention will be illustrated more concretely by Examples, however, not intended to be limited to them. In the Examples and Comparative Examples, a term of "parts" indicates weight part.

Example 1

According to the following recipe, dispersions of dye and color developing agent are separately ground in wet condition to average particle diameter of 1.0 $\mu$m by a sand grinder. And, the average particle size indicates the accumulated 50% diameter based on volume measured by a Mastersizer S, which is a product of MALVERN Co., Ltd.

| <dispersion of color developing agent> | |
|---|---|
| 4,4'-dihydroxydiphenylsulfone | 6.0 parts |
| 10% aqueous solution of polyvinyl alcohol | 18.8 parts |
| water | 11.2 parts |

-continued

| <dispersion of dye> | |
|---|---|
| 3-di-n-pentylamino-6-methyl-7-anilinofluoran (commercialized name: BLACK305, product of Yamada Chemicals Co., Ltd.) | 2.0 parts |
| 10% aqueous solution of polyvinyl alcohol | 4.6 parts |
| water | 2.6 parts |

The compounds mentioned below are mixed and the coating for thermally sensitive layer is obtained. The obtained coating is coated over the surface of 50 g/m$^2$ high grade paper and dried up so as to the coating amount is 6 g/m$^2$, and the obtained sheet is treated by a super calendar so as the Beck's smoothness become 200–600 sec. and the thermal recording material is obtained.

| | |
|---|---|
| dispersion of color developing agent | 36.0 parts |
| dispersion of dye | 9.2 parts |
| 50% dispersion of kaolin clay | 12.0 parts |

Example 2

By same process to Example 1 except changing the average particle size of dye to 0.5 $\mu$m in dye dispersion, the thermal recording material is obtained.

Example 3

By same process to Example 1 except changing the average particle size of dye to 0.3 $\mu$m in dye dispersion, the thermal recording material is obtained.

Example 4

By same process to Example 1 except using same dye dispersion to Example 2 and changing the blending ratio as mentioned below, the thermal recording material is obtained.

| | |
|---|---|
| dispersion of color developing agent | 36.0 parts |
| dispersion of dye | 27.6 parts |
| 50% dispersion of kaolin clay | 12.0 parts |

Example 5

By same process to Example 1 except using same dye dispersion to Example 2 and changing the blending ratio as mentioned below, the thermal recording material is obtained.

| | |
|---|---|
| dispersion of color developing agent | 36.0 parts |
| dispersion of dye | 4.6 parts |
| 50% dispersion of kaolin clay | 12.0 parts |

Example 6

By same process to Example 1 except changing 4,4'-dihydroxy diphenylsulfone to 2,4'-dihydroxydiphenylsulfone in color developing agent dispersion, the thermal recording material is obtained.

Comparative Example 1

By same process to Example 1 except changing 3-di-n-pentylamino-6-methyl-7-anilinofluoran to 3-(N-ethyl-N-isoamylamino)-6-methyl-7-anilino fluoran (S205; average particle size is 10 μm), the thermal recording material is obtained.

Comparative Example 2

By same process to Comparative Example 1 except changing the average particle size of dye to 0.5 μm in dye dispersion, the thermal recording material is obtained.

Comparative Example 3

By same process to Comparative Example 1 except changing the average particle size of dye to 0.3 μm in dye dispersion, the thermal recording material is obtained.

Comparative Example 4

By same process to Example 1 except changing 3-di-n-pentylamino-6-methyl-7-anilinofluoran to 3-di-n-buthylamino-6-methyl -7-anilinofluoran (ODB2; average particle size is 0.3 μm), the thermal recording material is obtained.

Comparative Example 5

By same process to Example 2 except changing color developing agent from 4,4'-dihydroxydiphenylsulfone to 4,4'-isopropylidenediphenyl, the thermal recording material is obtained.

The qualities mentioned below of thermally sensitive recording media obtained in above mentioned Examples and Comparative Examples are measured, and the obtained results are summarized in Tables 1 and 2. The numerical numbers in parenthesis indicate the blended parts.

Density of Image

Thermal recording is carried out on the prepared thermally sensitive recording media using UBI printer 201 (product of UBI) by 18 mJ/mm$^2$ and 26 mJ/mm$^2$ impressive energy. Image density of the printed part is measured by a Macbeth densitometer (RD914 umber filter used).

Degree of Whiteness of Ground Color

Degree of whiteness of not color developed portion of specimen is measured by a Hunter Whiteness tester (product of Tokyo Seiki Seisakusho, blue filter).

Heat Resistance

The specimen color developed by 26 mJ/mm$^2$ impressive energy using UBI printer 201 (product of UBI), is left in the atmosphere of 80° C. for 24, then the image density of specimen is measured by a Macbeth densitometer, and the degree of whiteness of not color developed portion of specimen is measured by a Hunter Whiteness tester (product of Tokyo Seiki Seisakusho, blue filter).

Resistance to Wet Heat

The specimen color developed by 26 mJ/mm$^2$ impressive energy using UBI printer 201 (product of UBI) and the specimen not color developed are left in the atmosphere of 40° C. and 90% humidity for 24 hours, and the image density of color developed part is measured by a Macbeth densitometer and the degree of whiteness of color developed part is measured by a Hunter Whiteness tester.

TABLE 1

| | dye | particle size | color developing agent |
|---|---|---|---|
| Example 1 | BLACK305 (2) | 1.0 μm | 4,4'-dihydroxydiphenylsulfone (6) |
| Example 2 | BLACK305 (2) | 0.5 μm | 4,4'-dihydroxydiphenylsulfone (6) |
| Example 3 | BLACK305 (2) | 0.3 μm | 4,4'-dihydroxydiphenylsulfone (6) |
| Example 4 | BLACK305 (6) | 0.5 μm | 4,4'-dihydroxydiphenylsulfone (6) |
| Example 5 | BLACK305 (1) | 0.5 μm | 4,4'-dihydroxydiphenylsulfone (6) |
| Example 6 | BLACK305 (2) | 0.5 μm | 2,4'-dihydroxydiphenylsulfone (6) |
| Comparative Example 1 | S205 (2) | 1.0 μm | 4,4'-dihydroxydiphenylsulfone (6) |
| Comparative Example 2 | S205 (2) | 0.5 μm | 4,4'-dihydroxydiphenylsulfone (6) |
| Comparative Example 3 | S205 (2) | 0.3 μm | 4,4'-dihydroxydiphenylsulfone (6) |
| Comparative Example 4 | ODB2 (2) | 0.3 μm | 4,4'-dihydroxydiphenylsulfone (6) |
| Comparative Example 5 | BLACK305 (2) | 0.5 μm | 4,4'-isopropylidenediphenol (6) |

TABLE 2

| | image density | | degree of white -ness of | heat resistance | | resistance to wet heat | |
|---|---|---|---|---|---|---|---|
| | 18 mJ/mm$^2$ | 26 mJ/mm$^2$ | ground color | color developed part | ground color | color developed part | ground part |
| Example 1 | 0.86 | 1.23 | 86% | 1.25 | 71% | 1.29 | 75% |
| Example 2 | 1.01 | 1.44 | 85% | 1.45 | 70% | 1.52 | 74% |
| Example 3 | 1.21 | 1.46 | 85% | 1.47 | 70% | 1.53 | 74% |
| Example 4 | 1.17 | 1.49 | 85% | 1.50 | 67% | 1.47 | 74% |
| Example 5 | 0.86 | 1.43 | 85% | 1.44 | 71% | 1.51 | 74% |
| Example 6 | 1.05 | 1.46 | 85% | 1.48 | 69% | 1.54 | 74% |
| Co. Example 1 | 0.75 | 1.18 | 83% | 1.23 | 60% | 1.28 | 62% |
| Co. Example 2 | 0.88 | 1.39 | 82% | 1.45 | 58% | 1.49 | 60% |
| Co. Example 3 | 0.98 | 1.40 | 79% | 1.46 | 55% | 1.49 | 57% |
| Co. Example 4 | 1.14 | 1.43 | 79% | 1.47 | 62% | 1.47 | 67% |
| Co. Example 5 | 1.42 | 1.49 | 85% | 1.01 | 60% | 1.58 | 75% |

Co. Example means Comparative Example

As clearly understood from the results of Table 1 and Table 2, Examples 1 to 6 which satisfy the important points of this invention, are well balanced in color developing density, degree of whiteness of ground color, resistance to heat and image retention. Especially, Examples 2 and 3 in which average diameter of dye is restricted to smaller than 0.5 $\mu$m, show high color developing density and the deterioration of whiteness is not observed. In the meanwhile, comparative Examples 1 to 3, which use S205 as dye, are inferior in color developing density, heat resistance and resistance to wet heat of ground color. Comparative Example 4 which uses ODB2 of 0.3 $\mu$m is inferior in whiteness of ground color, heat resistance and resistance to wet heat of white part. And in Comparative Example 5 which uses 4,4'-isopropylidendiphenol as a color developing agent is inferior in heat resistance of color developed part and white color part.

Possibility to be Used in an Industrial Scale

The thermal recording material which has high degree of whiteness and ground color does not colored in high temperature and high humid condition, color developed part does not fade and is stabilized for long term preservation is obtained.

What is claimed is:

1. A thermal recording material that possesses a thermally sensitive color developing layer containing colorless or pale colored basic colorless dye and organic color developing agent as main components on a substrate, wherein said thermally sensitive recording layer contains at least one kind of dihydroxydiphenylsulfone type compound represented by general formula (1) as the organic color developing agent, and consists of 3-di-n-pentylamino-6-methyl-7-anilinofluoran as the basic colorless dye.

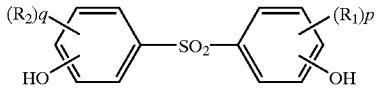

(1)

wherein, $R_1$ and $R_2$ indicate an alkyl group or an alkenyl group of carbon number 1 to 8, or a halogen atom and p and q is an integer number of 0 to 3.

2. The thermal recording material of claim 1 that contains 4,4'-dihydroxydiphenylsulfone as the organic color developing agent.

3. The thermal recording material of claim 2, wherein the average particle size of 3-di-n-pentylamino-6-methyl-7-anilinofluoran is smaller than 0.5 $\mu$m.

4. The thermal recording material of claim 2, wherein the average particle size of 3-di-n-pentylamino-6-methyl-7-anilinofluoran is smaller than 0.3 $\mu$m.

5. The thermal recording material of claim 1, wherein the average particle size of 3-di-n-pentylamino-6-methyl-7-anilinofluoran is smaller than 0.5 $\mu$m.

* * * * *